US006771223B1

(12) United States Patent
Shoji et al.

(10) Patent No.: US 6,771,223 B1
(45) Date of Patent: Aug. 3, 2004

(54) ANTENNA DEVICE AND PORTABLE MACHINE

(75) Inventors: Hideaki Shoji, Tokyo (JP); Yasuhito Imanishi, Tokyo (JP); Toru Fukasawa, Tokyo (JP); Hiroyuki Ohmine, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 22 days.

(21) Appl. No.: 10/168,530

(22) PCT Filed: Oct. 31, 2000

(86) PCT No.: PCT/JP00/07640

§ 371 (c)(1),
(2), (4) Date: Jun. 28, 2002

(87) PCT Pub. No.: WO02/39544

PCT Pub. Date: May 16, 2002

(51) Int. Cl.[7] ..... H01Q 1/24
(52) U.S. Cl. ..... 343/702; 343/700 MS
(58) Field of Search ..... 343/700 MS, 702, 343/876, 846

(56) References Cited

FOREIGN PATENT DOCUMENTS

| | | |
|---|---|---|
| EP | 0 546 803 | 6/1993 |
| JP | 56-27507 | 3/1981 |
| JP | 64-77304 | 3/1989 |
| JP | 2-94713 | 4/1990 |
| JP | 3-192903 | 8/1991 |
| JP | 5-308216 | 11/1993 |

*Primary Examiner*—Michael C. Wimer
(74) *Attorney, Agent, or Firm*—Oblon, Spivak, McClelland, Maier & Neustadt, P.C.

(57) ABSTRACT

An antenna device includes: a conductive board (3) having one end portion and the other end portion opposite the one end portion; a flat plate antenna(4, 18*a*, 18*b*, 19) mounted on the board (3) with a dielectric interposing therebetween wherein when feeding a current thereto to excite, a current also flows in said board (3); a first current direction change means (5*a*, 6, 6*a*, 6*c*, 7, 7*a*, 7*c*, 14*a*, 17*a*, 17*c*, 21*a*, 22*a*, 22*b*, 24*a*) changing a direction of the current flowing in the board (3) to a first direction when exciting the antenna (4, 18*a*, 18*b*, 19) and located on said one end portion of the board (3); and a second current direction change means (5*b*, 6, 6*b*, 6*d*, 7, 7*b*, 7*d*, 14*b*, 17*b*, 17*d*, 21*b*, 22*c*, 22*d*, 24*b*) changing a direction of the current flowing in the board (3) to a second direction different from the first direction when exciting said antenna (4, 18*a*, 18*b*, 19) and located on the other end portion of the board (3).

11 Claims, 10 Drawing Sheets

ANTENNA DEVICE AND PORTABLE MACHINE

TECHNICAL FIELD

The present invention relates to an antenna device and portable equipment, and more particularly, to an antenna device and portable equipment capable of reducing a size and weight thereof.

BACKGROUND ART

In recent years, a portable telephone has been widely spread. In mobile communication to use this portable telephone or the like, transmission waves are subjected to multi-reflection or scattering caused by buildings or the like present between a portable telephone as a mobile station and a base station. For this reason, polarization fluctuation of radio waves and others occur, resulting in level fluctuation of a received signal in a portable telephone and in turn, in deterioration in communication quality. In order to alleviate such deterioration in communication quality, there has been employed the diversity reception in which radio waves are received using two antennae and received signals through the antennae are synthesized or one thereof at a higher level is selected, thereby alleviating an influence of level fluctuation on a received signal.

FIG. 14 is a view showing a conventional portable telephone in a simplified manner. Description will be given of the conventional portable telephone with reference to FIG. 14.

Referring to FIG. 14, a portable telephone 101 adopts a so-called space diversity reception scheme as a measure to alleviate the deterioration in communication quality, including: two antennae of a whip antenna 150; and a built-in antenna 151 such as a flat plate antenna mounted inside a case of portable telephone 101.

In portable telephone 101 shown in FIG. 14, since antenna 150 and built-in antenna 151 for transmitting/receiving radio waves in the same band are installed adjacent to each other, a problem has been arisen that antenna 150 and built-in antenna 151 are electromagnetically coupled with each other to deteriorate an efficiency of the antenna.

Furthermore, as another type of the diversity reception, there has also been known a so-called polarization diversity reception scheme using a patch antenna. FIGS. 15 and 16 are model diagrams each showing an antenna device adopting a polarization diversity reception scheme.

Referring to FIG. 15, a patch antenna 152 is mounted on a board 103. Feed points 105*a* and 105*b* connected to a feed source are provided on adjacent sides of the periphery of patch antenna 152. By switching between feed points 105*a* and 105*b*, a plane of polarization of the patch antenna can be changed over from one of two directions indicated by two arrow marks 153 and 154 to the other. Moreover, as shown in FIG. 16, in the patch antenna 152, by switching between ground points 114*a* and 114*b* instead of feed points, switching between planes of polarization can also be realized. Referring to FIG. 16, ground points 114*a* and 114*b* grounding patch antenna 152 to the board are provided on adjacent side of a periphery of patch antenna 152. Furthermore, a feed point 105 connected to a feed source is provided on patch antenna 152.

Since such a patch antenna has a large antenna size, however, it, as was in the prior art, has been hard to be applied to portable equipment such as a portable telephone requiring reduction in size and weight.

As described above, in portable equipment such as a portable telephone requiring reduction in size and weight, it has been hard to suppress deterioration in communication quality without reducing an efficiency of an antenna.

The present invention has been made in order to solve such a problem and it is an object of the present invention to provide an antenna device and portable equipment capable of reducing a size and weight thereof and preventing deterioration in communication quality to be otherwise caused by polarization fluctuation of a radio wave and others without decreasing an antenna efficiency.

DISCLOSURE OF THE INVENTION

An antenna device in a first aspect of the present invention includes: a conductive board having one end portion and the other end portion opposite the one end portion; a flat plate antenna; first current direction change means; and second current direction change means. The flat plate antenna is mounted on the board with a dielectric interposing therebetween and when feeding a current thereto to excite, a current also flows in the board. The first current direction change means changes a direction of the current flowing in the board to a first direction when exciting said antenna and located on the one end portion of the board. The second current direction change means changes a direction of the current flowing in the board to a second direction different from the first direction when exciting the antenna and located on the other end portion of the board.

With such a construction adopted, directions of a strength of a radio wave radiated from the antenna device including the antenna and the board can be changed therebetween in respective cases where a direction of a current flowing in the board is the first direction and where a direction of a current flowing in the board is the second direction. That is, the directivity of the antenna can be changed. Here, the first direction is, for example, a direction along a diagonal line extending from the one end portion of the board to the opposite corner of the board and the second direction is exemplified as a direction along a diagonal line extending from the other end portion of the board to the opposite corner of the board. Furthermore, since a direction of the current flowing in the board is different according to the first direction or the second direction, a main polarization direction of the antenna device in each of the respective cases is different from that in the other cases. That is, by changing a direction of current flowing in the board from the first direction to the second direction and vice versa, directivity and a polarization direction of the antenna device can be changed. Therefore, an antenna device can be realized that operates as if it had two antennae different in directivity and polarization from each other using one antenna. As a result, the diversity reception can be implemented using one antenna. Accordingly, since no necessity arises for two antennas, which was required in a conventional practice, thereby preventing from occurrence of a problem of electromagnetic coupling between two antennas.

Furthermore, since functions of two antennas are realized with one antenna, a size and weight of an antenna device can be reduced compared with those in a case where two separate antennas are installed.

In the antenna device according to the above first aspect, the antenna may be installed so as to extend from a position on the one end portion of the board to a position on the other end portion of the board. The first current direction change means may include first feed means, which is connected to one portion of the antenna located on the one end portion of the board, for exciting the antenna and first feed control means for controlling feed of a current to the antenna from the first feed means. The second current direction change means may include second feed means, which is connected to another portion of the antenna located on the other end portion of the board, for exciting the antenna and second feed control means for controlling feed of a current to the antenna from the second feed means.

In this case, by switching between the first and second feed means using the first and second feed control means, a position of a feed point of the antenna can be changed over from a position in the one portion of the antenna to a position in the second portion of the antenna. By switching between positions of feed points in this way, a direction of the current flowing in the board can be easily changed over from the first direction to the second direction and vice versa. As a result, since an antenna device can be realized that operates as if it had two antennas different in directivity and polarization from each other using one antenna, the diversity reception can be realized using one antenna.

The antenna device according to the above first aspect may further include feed means for exciting the antenna. The antenna may be installed so as to extend from a position on the one end portion of the board to a position on the other end opposite the one end portion of the board. The first current direction change means may include a first ground means electrically connecting one portion of the antenna located on the one end portion of the board with the one end portion of the board and a first ground control means controlling connection of the first ground means with the antenna. The second current direction change means may include a second ground means electrically connecting a second portion of the antenna located on the other end portion of the board with the other end portion of the board and a second ground control means controlling connection of the second ground means with the antenna.

In this case, by switching between the first and second ground means, a position of a ground point of the antenna can be changed over from a position in the one portion of the antenna to a position in the second portion of the antenna. By switching between positions of the ground points in this way, a direction of the current flowing in the board can be easily changed over from the first direction to the second direction and vice versa. As a result, since an antenna device can be realized that operates as if it had two antennas different in directivity and polarization from each other using one antenna, the diversity reception can be realized using one antenna.

In the antenna device according to the above first aspect, the feed means is preferably connected to the central portion of the antenna; in the first ground means, the one end portion of the board is preferably connected to the one portion of the antenna at a first ground point of the one portion of the antenna; and in the second ground means, the other end portion of the board is preferably connected to the second portion of the antenna at a second ground point of the second portion of the antenna. The first ground point and the second ground point are preferably located at positions in bilateral symmetry with respect to the central portion of the antenna.

In this case, since the first and the second ground points are preferably located positions in bilateral symmetry with respect to the central portion of the antenna, common feed means for the first and second ground points can be provided at the central portion of the antenna. As a result, a construction of the antenna device can be simplified as compared with that in a case where two feed means corresponding to the first and second ground points are provided in an antenna device.

In the antenna device according to the above first aspect, the antenna may be installed so as to extend from a position on the one end portion of the board to a position on the other end portion opposite the one end portion of the board, and the first current direction change means may include: a first ground means electrically connecting one portion of the antenna located on the one end portion of the board to the one end portion of the board; a first feed means, connected to the one portion of the antenna located on the one end portion of the board, and for exciting the antenna; and a first feed ground control means switching between the first ground means and the first feed means. The second current direction change means may include: a second ground means electrically connecting a second portion of the antenna located on the other end portion of the board to the other end portion of the board; a second feed means, connected to the second portion of the antenna located on the other end portion of the board, and for exciting the antenna; and a second feed ground control means switching between the second ground means and the second feed means.

In this case, by controlling the first and second feed ground control means, a feed point and a ground point of the antenna can be arbitrarily provided in one of a region located on the one end portion of the board and a region located on the other end portion of the board. By switching between positions of a ground point and a feed point in this way, a direction of the current flowing in the board can be easily changed over from the first direction to the second direction and vice versa. As a result, since an antenna device can be realized that operates as if it had two antennas different in directivity and polarization from each other using one antenna, the diversity reception can be realized using one antenna.

In the antenna device according to the above first aspect, an electrical length of the antenna is preferably substantially ¼ times a wavelength of a radio wave that can be received by the antenna.

In this case, a so-called $\lambda/4$-wave antenna ($\lambda$ indicates a wavelength of a radio wave) is advantageous in reducing its size and by using such an antenna, further reduction in size and weight of an antenna device can be realized.

In the antenna device according to the above first aspect, the antenna preferably includes a first element capable of receiving a radio wave having a first frequency; and a second element capable of receiving a radio wave having a second frequency different from the first frequency.

In this case, by applying the present invention in a multi-frequency antenna device including the first and second elements, a direction of a current flowing in the board can be changed over from the first direction to the second direction and vice versa. Thereby, directivity and a polarization direction of an antenna device can be changed. That is, since one multi-frequency antenna can operates as if it were two antennas different in directivity and polarization from each other, the diversity reception can be easily realized using one multi-frequency antenna.

In the antenna device according to the above first aspect, the first current direction change means may include: a first feed source feeding a current having a first frequency for exciting the antenna; a second feed source feeding a current having a second frequency different from the first frequency for exciting the antenna; a first filter transmitting a current having the first frequency; and a second filter transmitting a current having the second frequency. The first feed source may be connected to a first common connection point of the antenna through the first filter, and the second feed source may be connected to the first common connection point of the antenna through the second filter. The second current direction change means may include: a third feed source feeding a current having the first frequency for exciting the antenna; a fourth feed source feeding a current having the second frequency different from the first frequency for exciting the antenna; a third filter transmitting a current having the first frequency; and a fourth filter transmitting a current having the second frequency. The third feed source may be connected to a second common connection point of the antenna through the third filter, and the fourth feed source may be connected to the second common connection point of the antenna through the fourth filter.

In this case, with the first and second filters used, the first and second feed source feeding currents having respective different frequencies can be connected to the first common connection point of the antenna. Furthermore, with the third and fourth filters used, the third and fourth feed source feeding currents having respective different frequencies can be connected to the second common connection point of the antenna. That is, since plural feed sources can be connected to the antenna by one connection point, the number of connection points of feed sources to the antenna can be reduced. As a result, a construction of the antenna can be simplified. Hence, the antenna device can be reduced in size and weight.

In the antenna device according to the above first aspect, the antenna may include a part having a function as a conductive wire for a current fed to the antenna and a function as a matching element.

In this case, since no necessity arises for installment of a separate matching element in addition to the antenna, a simpler construction of the antenna device can be realized. Hence, the antenna device can be reduced in size and weight.

In the antenna device according to the above first aspect, the first current direction change means may includes: a first matching circuit member; and a first feed means electrically connected to the antenna through the first matching circuit member, and the second current direction change means may include: a second matching circuit member; and second feed means electrically connected to the antenna through the second matching circuit member.

In this case, with the first and second matching circuits used, a characteristic of the antenna can be finely adjusted.

Portable equipment in another aspect is provided with the antenna device according to the first aspect.

With such construction adopted, since one antenna device can operate as if it were two antennas different in directivity and polarization from each other, reduction in size and weight of portable equipment can be achieved compared with an antennas device in a case where two antennas are actually installed.

BEST MODE FOR CARRYING OUT THE INVENTION

Figure 1:
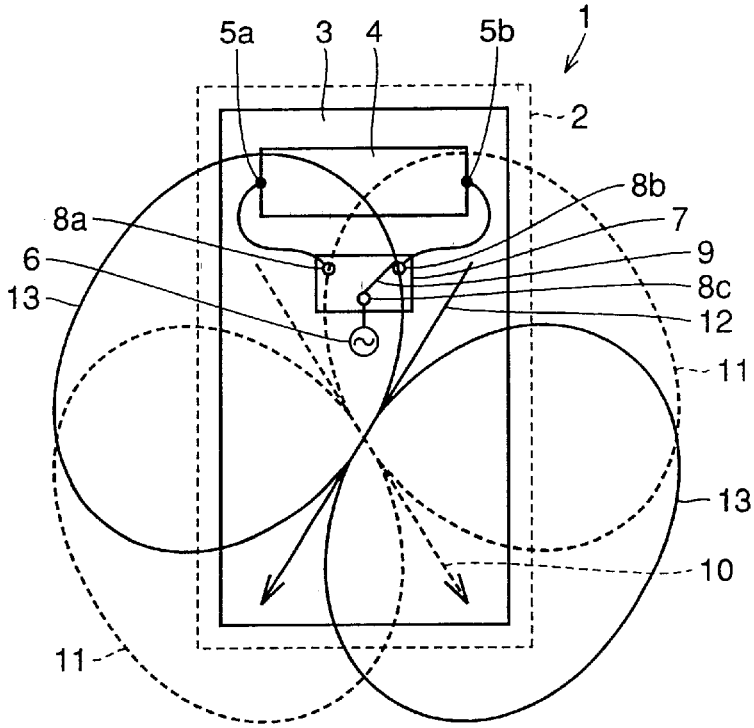
FIG. 1 is a model diagram showing a first embodiment of a portable telephone according to the present invention.

Description will be given of embodiments of the present invention below with reference to the accompanying drawings. Note that in the following drawings, the same or corresponding constituents are attached by the same reference numerals and none of descriptions thereof is repeated.

(First Embodiment)

Description will be given of a first embodiment according to the present invention with the reference to FIG. 1.

Referring to FIG. 1, a portable telephone 1 includes: a case 2 constituting a body; a conductive board 3 mounted inside case 2; and a flat plate antenna 4 installed on board 3 with a clearance therebetween. A ground point, though not shown, electrically connected to board 3 is provided to flat plate antenna 4. Feed points 5*a* and 5*b* are provided at both end portions of flat plate antenna 4. Feed point 5*a* provided at one end portion as one portion of flat plate antenna 4 is electrically connected to a terminal 8*a* on a change-over switch 7 by a conductive wire. Feed point 5*b* provided at the other end portion as another portion of flat plate antenna 4 is electrically connected to a terminal 8*b* provided on change-over switch 7. A terminal 8*c* on change-over switch 7 is electrically connected to a feed source 6 by a conductive wire. By electrically connecting terminal 8*c* to which feed source 6 is connected to one of terminals 8*a* and 8*c* using a conductive wire 9 or the like, a current for exciting flat plate antenna 4 can be fed thereto from one of two feed points 5*a* and 5*b* of flat plate antenna 4. That is, with change-over switch 7 provided, feed of a current from feed source 6 to flat plate antenna 4 through feed points 5*a* and 5*b* can be ON/OFF controlled. Here, flat plate antenna 4 is a quarter wavelength antenna (an antenna of a $\lambda/4$ type, wherein $\lambda$ indicates a wavelength of a radio wave) and for example, when terminals 8*a* and 8*c* are connected to each other to feed a current from feed point 5*a* to flat plate antenna 4, the current flows in a direction (a direction along a diagonal line extending from the one end portion of board 3 to the opposite corner thereof) shown with a dotted line 10 as a first direction in board 3 electrically connected to flat antenna 4. Directivity of antenna 4 when a current flows as shown with the dotted line 10 is simply indicated with a dotted line 11. Moreover, when terminals 8*b* and 8*c* are connected to each other to feed a current from feed point 5*b* to flat plate antenna 4, the current flows in a direction (a direction along a diagonal line extending from the other end portion of board 3 to the opposite corner thereof) shown with a solid line 12 as a second direction in board 3 electrically connected to flat antenna 4. Directivity of antenna 4 when a current flows as shown with solid line 12 is simply indicated with a solid line 13.

In such a manner, directions of a strength of a radio wave can be changed over therebetween in respective cases where a direction of the current flowing in board 3 is a direction shown dotted line 10 as the first direction and where the direction of the current is a direction shown with solid line 12 as the second direction. That is, directivity of an antenna device can be changed.

Further, since directions of a current flowing in the board are different from each other in the respective cases of the first direction shown with dotted line 10 and the second direction shown with the solid line 12, polarization directions of the antenna device in both cases are different from each other. Therefore, by selecting the first direction or second direction, both being different from each other as a direction of the current flowing in board 3, directivity and a polarization direction of the antenna device can be changed. For this reason, portable telephone 1 equipped with an antenna device can be realized that operates as if it had two antennas different in directivity and polarization from each other using one flat plate antenna 4. As a result, a diversity reception scheme can be realized using one flat plate antenna 4. Therefore, since two antennas, which were required in a prior art, are not required, thereby preventing from occurrence of a problem of electromagnetic coupling between two antennas.

Furthermore, since functions of two antennas are realized using one flat plate antenna 4, portable telephone 1 can be smaller and lighter than in a case of portable telephone equipped with two separate antennas.

In addition, by switching between feed points 5*a* and 5*b* connected to feed source 6 using change-over switch 7 as first and second feed control means, positions of a feed point can be changed over therebetween in respective end portions of flat plate antenna 4 (change-over from the one portion to the second portion of flat plate antenna 4). In such a way, by connecting one of feed points 5*a* and 5*b* to feed source 6 to act as a feed point feeding a current to flat plate antenna 4, change-over can be easily performed between the first direction (a direction shown with dotted line 10) and the second direction (a direction shown with solid line 12) of the current flowing in board 3.

Moreover, since a so-called $\lambda/4$ antenna as shown in FIG. 1 is small in size, portable telephone 1 can be realized in a smaller and lighter form. Note that as an antenna used in the present invention, there can be used antennas other than the so-called above $\lambda/4$ antenna, such as a $3\lambda/8$ antenna.

(Second Embodiment)

Description will be given of a second embodiment of a portable telephone according to the present invention with the reference to FIG. 2.

Figure 2:
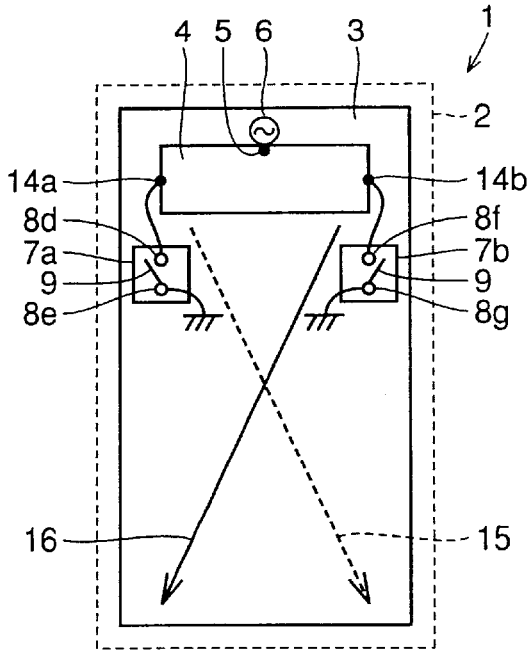
FIG. 2 is a model diagram showing a second embodiment of a portable telephone according to the present invention.

Referring to FIG. 2, a portable telephone 1 has a construction fundamentally similar to the portable telephone shown in FIG. 1. In portable telephone 1 shown in FIG. 2, however, a ground point 14*a* is provided at one end portion as one portion of a flat plate antenna 4, and a ground point 14*b* is provided at the other end portion as a second portion. Furthermore, a feed point 5 electrically connected to a feed source 6 is provided in the central portion of flat plate antenna 4. Ground point 14*a* is electrically connected to a terminal 8*d* on a change-over switch 7*a* by a conductive wire. Besides, a terminal 8*e* grounded to a board 3 is provided on change-over switch 7*a*. Terminals 8*d* and 8e are connected to each other using a conducting wire 9 or the like, or alternatively are placed in an open state without connecting terminals 8*d* and 8*e* therebetween, thereby enabling control on the presence or absence of grounding to board 3 at ground point 14*a* of flat plate antenna 4 (a state, open or closed, in grounding flat plate antenna 4 to board 3).

Furthermore, a ground point 14*b* provided at the other end portion of flat plate antenna 4 is connected to a terminal 8*f* provided on a change-over switch 7*b* by a conductive wire. Moreover, a terminal 8*g* grounded to board 3 is provided on change-over switch 7*b*. Terminals 8*f* and 8*g* are electrically connected to each other by conductive wire 9 or the like, or alternatively are placed in an open state without connecting terminals 8*f* and 8*g* therebetween, by which change-over operation control is enabled on the presence or absence of grounding to board 3 at ground point 14*b* of flat plate antenna 4. By changing over from an operation connecting terminals 8*d* and 8*e* therebetween to an operation disconnecting terminals 8*f* and 8*g* from each other and vice versa at change-over switches 7*a* and 7*b*, respectively, only one of ground points 14*a* and 14*b* of flat plate antenna 4 can be placed in a state of being connected to board 3.

In a case where while terminals 8*d* and 8*e* of change-over switch 7*a* are connected to each other by conductive wire 9, terminals 8*f* and 8*g* of change-over switch 7*b* are, on the other hand, not connected to each other (in an open state), thereby grounding ground point 14*a* to board 3, a current flows in a direction indicated by a dotted line 15 in board 3 upon exciting of flat plate antenna 4. Furthermore, in a case where while terminals 8*d* and 8*e* of change-over switch 7*a* assume an open state, terminals 8*f* and 8*g* of change-over switch 7*b* are, on the other hand, connected to each other by conductive wire 9, thereby grounding ground point 14*b* to board 3, a current flows in a direction indicated by a solid line 16 in board 3.

By selectively using ground point 14*a* or 14*b* to change over between ground points of flat plate antenna 4, directions of a current flowing in board 3 can be changed with ease, similar to the portable telephone according to the first embodiment of the present invention. As a result, there can be obtained an effect similar to the first embodiment of a portable telephone according to the present invention.

Furthermore, as shown in FIG. 2, since ground points 14*a* and 14*b* are located in bilateral symmetry with respect the central portion of flat plate antenna 4, feed means 5 shared between ground points 14*a* and 14*b* can be provided at the central portion of flat plate antenna 4. As a result, a construction of telephone 1 can be simpler than in a case where two feed points are provided in correspondence to two ground points 14*a* and 14*b* in flat plate antenna 4 of portable telephone 1.

(Third Embodiment)

Description will be given of a third embodiment of a portable telephone according to the present invention with reference to FIG. 3.

Figure 3:
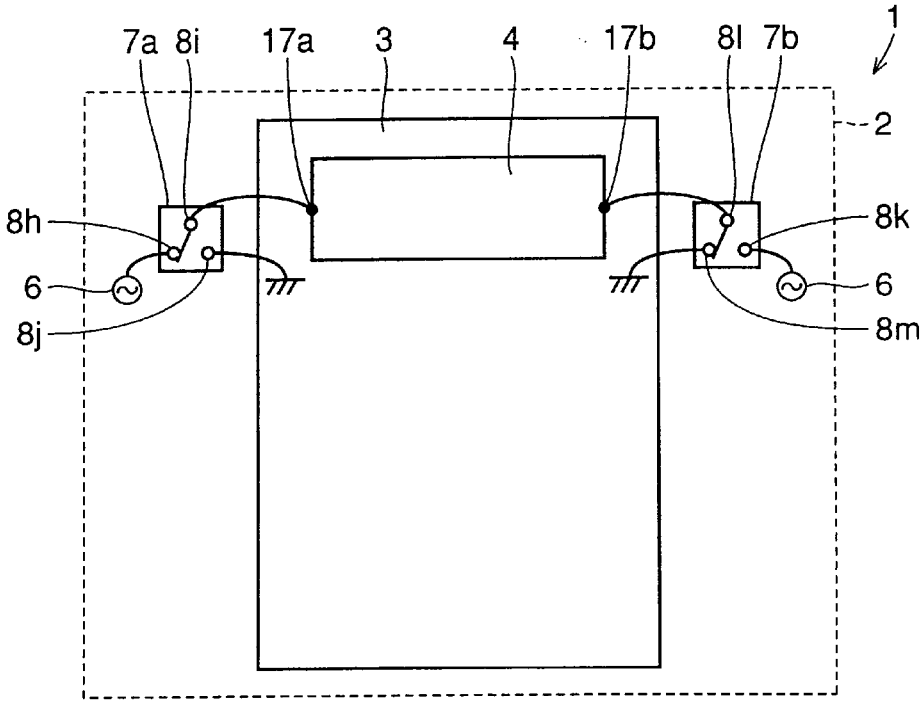
FIG. 3 is a model diagram showing a third embodiment of a portable telephone according to the present invention.

Referring to FIG. 3, a portable telephone 1 has a construction fundamentally similar to the portable telephone shown in FIG. 2. However, feed/ground terminals 17*a* and 17*b* to play roles both of a feed point and a ground point are provided at both end portions of a flat plate antenna 4. Feed/ground point 17*a* is electrically connected to a terminal 8*i* provided on a change-over switch 7*a* by a conductive wire or the like. In addition, a terminal 8*h* electrically connected to a feed source 6 and a terminal 8*j* grounded to one end portion of a board 3 are provided to change-over switch 7*a*. Terminal 8*i* and each of terminals 8*h* and 8*j* are connectable therebetween by a conductive wire or the like. Terminal 8*i* can be electrically connected to one of terminals 8*h* and 8*j* by changing over between terminals 8*h* and 8*j*.

Feed/ground point 17*b* disposed in the other end portion of flat plate antenna is electrically connected to a terminal 8*l* provided on a change-over switch 7*b* by a conductive wire or the like. A terminal 8*k* electrically connected to feed source 6 and a terminal 8*m* grounded to the other end portion of board 3 are provided to change-over switch 7*b*. Switching is enabled between electrical connections of terminal 8*l* with each of terminals 8*m* and 8*k*.

In this case, by controlling change-over switches 7*a* and 7*b* as first and second feed ground control means, a feed point and a ground point of flat plate antenna 4 can be arbitrarily set at any of a region located on the one end portion of board and a region located on the other end portion on board. By switching between a ground point and a feed point in flat plate antenna 4, a direction of a current flowing in board 3 can be easily changed, similarly to the first and second embodiments of the present invention. There can be achieved an effect similar to a portable telephone in any of the first and second embodiments of the present invention.

(Fourth Embodiment)

Description will be given of a fourth embodiment of a portable telephone according to the present invention with reference to FIG. 4.

Figure 4:
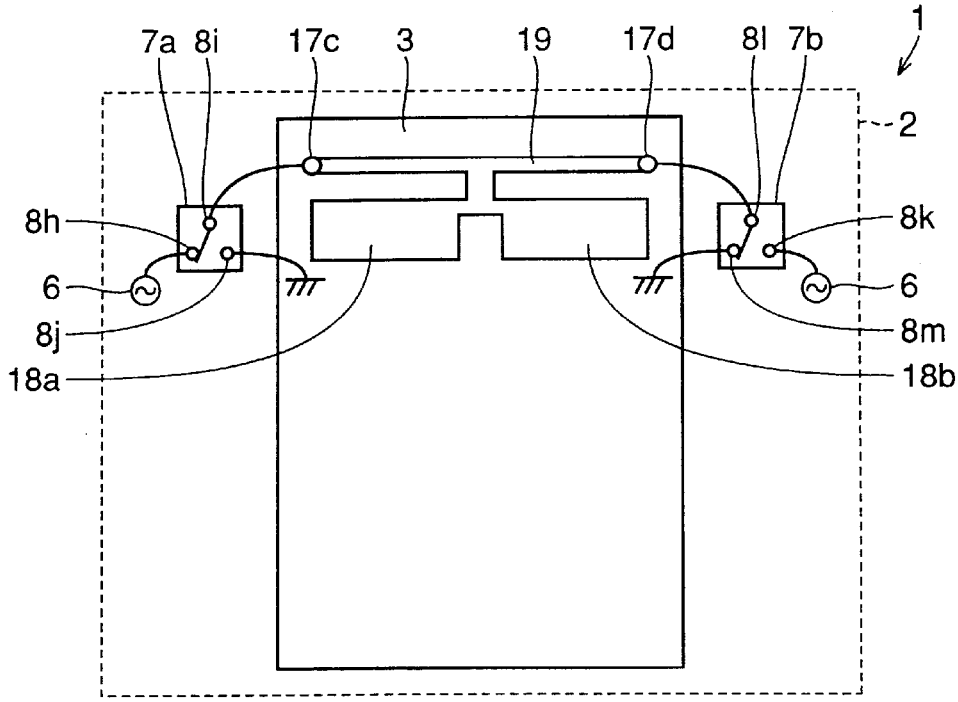
FIG. 4 is a model diagram showing a fourth embodiment of a portable telephone according to the present invention.

Referring to FIG. 4, a portable telephone 1 has a construction fundamentally similar to the portable telephone shown in FIG. 3. However, in portable telephone shown in FIG. 4, an antenna includes: a resonance element 18*a* adapted to a radio wave having a first frequency; a resonance element 18*b* adapted to a radio wave having a second frequency different from the first frequency; and an antenna element 19, electrically connected to resonance elements 18*a* and 18*b*, playing both rolls of a feed line as a conductive wire and a short stub as a matching element. With such a construction, since no necessity arises for installment of a separate matching element in addition to the antenna in portable telephone 1, a construction of portable telephone 1 can be simplified. Therefore, there can be achieved reduction in size and weight of portable telephone 1.

Feed/ground points 17*c* and 17*d* are provided at both end portions of antenna element 19. Feed/ground point 17*c* is electrically connected to a terminal 8*i* on a switch 7*a*, and feed/ground point 17*d* is electrically connected to a terminal 8*l* on a switch 7*b*. By controlling change-over switches 17*a* and 17*b*, feed/ground points 17*a* and 17*b* of the antenna can be acted as a feed point or a ground point (switching between feed points or ground points). As a result, a direction of the current flowing in a board 3 can be changed, similar to the third embodiment of the present invention.

In such a way, since even in a multi-frequency antenna device including resonance elements 18*a* and 18*b* as first and second elements, a direction of a current flowing in board 3 can be changed, directivity and a polarization direction of portable telephone 1 can be changed. Therefore, there can be attained an effect similar to the third embodiment of the present invention.

(Fifth Embodiment)

Description will be given of a fifth embodiment of a portable telephone according to the present invention with reference to FIG. 5.

Figure 5:
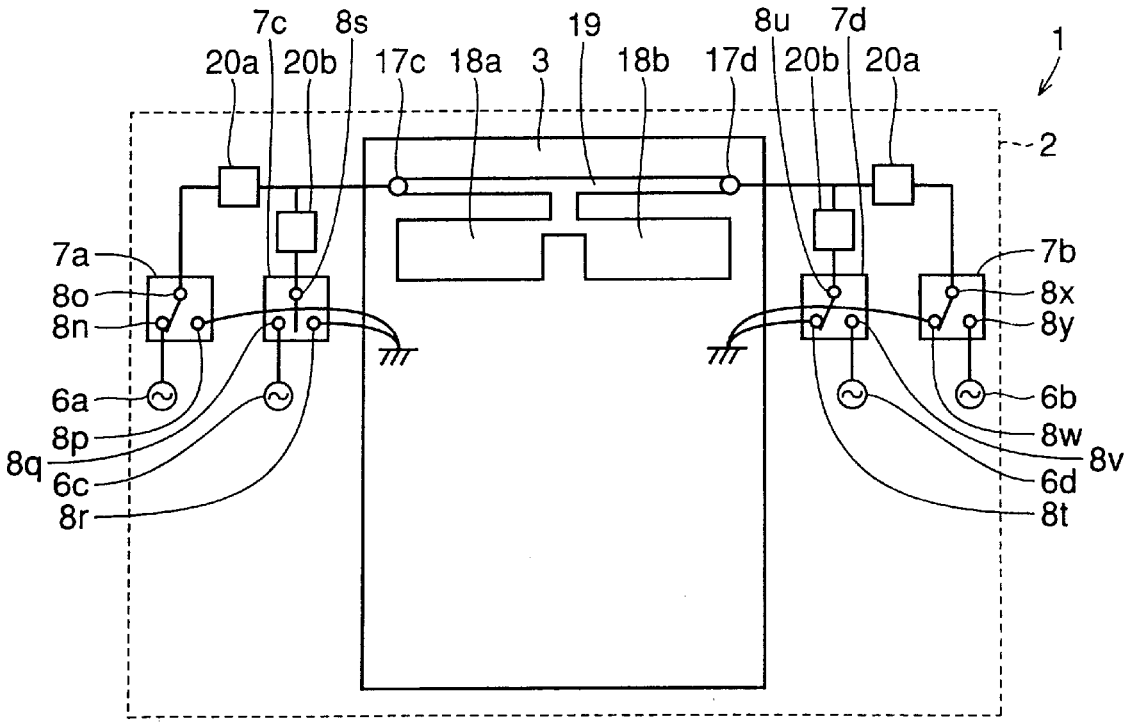
FIG. 5 is a model diagram showing a fifth embodiment of a portable telephone according to the present invention.

Referring to FIG. 5, a portable telephone 1 has a construction fundamentally similar to the portable telephone shown in FIG. 4. However, a feed/ground point 17*c* provided at an end portion of an antenna element 19 is electrically connected to terminals 8*o* and 8*s* on respective changeover switches 7*a* and 7*c*. Feed/ground point 17*c* is connected to terminal 8*o* through a filter 20*a* a as a first filter transmitting a current having a first frequency. Furthermore, feed/ground point 17*c* is connected to terminal point 8*s* through a filter 20*b* as a second filter transmitting a current having a second frequency. A terminal 8*n* electrically connected to a feed source 6*a* feeding a current having the first frequency is provided on change-over switch 7*a*. Furthermore, a terminal 8*p* grounded to one end portion of a board 3 is provided on change-over switch 7*a*. Switching between connections of terminal 8*o* with each of terminals 8*m* and 8*p* is enabled in change-over switch 7*a*.

Furthermore, a terminal 8*q* electrically connected to a feed source 6*c* for feeding a current having a second frequency and a terminal 8*r* connected to one end portion of board 3 are provided on change-over switch 7*c*. Switching between connections of terminal 8*s* with each of terminals 8*q* and 8*r* is enabled in change-over switch 7*c*.

Furthermore, a feed/ground point 17*d* provided at the other end portion of antenna element 19 is electrically connected terminals 8*x* and 8*u* provided on change-over switches 7*b* and 7*d*. Feed/ground point 17*d* is connected to terminal 8*x* through filter 20*a* a as a third filter transmitting a current having the first frequency. Furthermore, feed/ground point 17*d* is connected to terminal point 8*u* through filter 20*b* as a fourth filter transmitting a current having the second frequency. A terminal 8*y* connected to a feed source 6*b* for feeding a current having the first frequency and a terminal 8*w* grounded to the other end portion of board 3 are provided on change-over switch 7*b*. Switching between connections of terminal 8*x* with each of terminals 8*y* and 8*w* is enabled in change-over switch 7*b*. A terminal 8*v* connected to a feed source 6*d* for feeding a current having the second frequency and a terminal 8*t* grounded to the other end portion of board 3 are provided on change-over switch 7*d*. Switching between connections of terminal 8*u* with each of terminals 8*t* and 8*v* is enabled in change-over switch 7*d*.

With such a construction adopted, not only an effect similar to the fourth embodiment can be achieved, but feed sources 6*a* and 6*c* feeding currents having respective different frequencies can be connected to feed/ground point 17*c* as a first common connection point of the antenna by using filters 20*a* and 20*b*. Furthermore, by using filters 20*a* a and 20*b* disposed on the right side of FIG. 5, feed sources 6*b* and 6*d* feeding currents having respective different frequencies can be connected to feed/ground point 17*d* as a second common connection point of the antenna, that is since two feed sources 6*a* and 6*c* can be connected to the antenna with feed/ground point 17*c* and other two feed points 6*b* and 6*d* can be connected to the antenna with feed/ground point 17*d*, the number of connection points of feed sources with the antenna can be reduced. As a result, a construction of the antenna can be simplified. Therefore, there can be achieved reduction in size and weight of portable telephone 1.

(Sixth Embodiment)

Description will be given of a sixth embodiment of a portable telephone according to the present invention with reference to FIG. 6.

Figure 6:
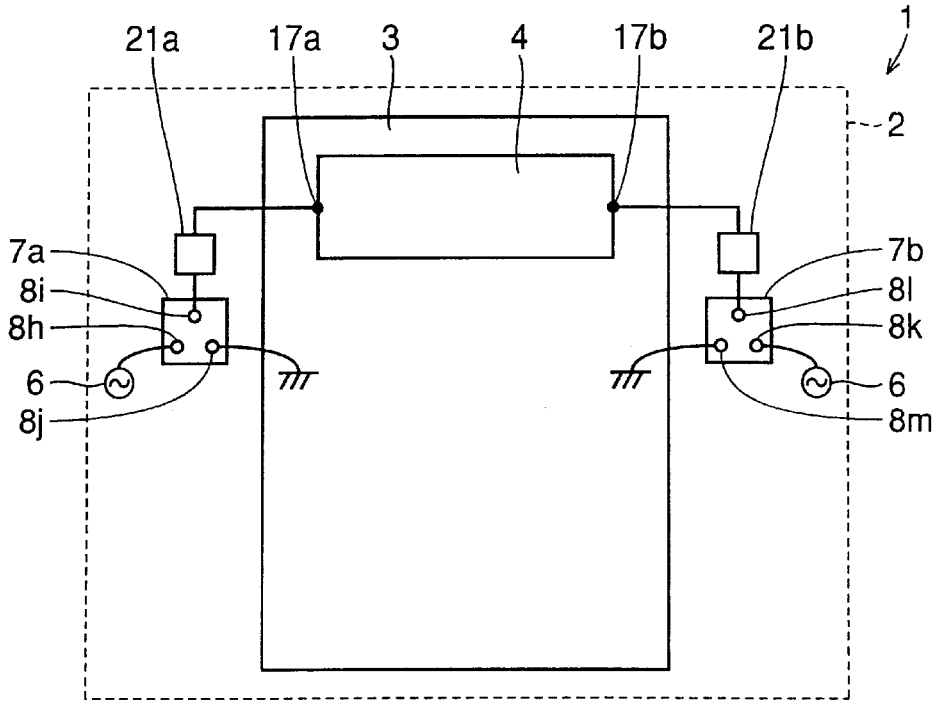
FIG. 6 is a model diagram showing a sixth embodiment of a portable telephone according to the present invention.

Referring to FIG. 6, a portable telephone 1 has a construction fundamentally similar to the portable telephone shown in FIG. 3. However, a feed/ground point 17*a* of a flat plate antenna 4 is electrically connected to a terminal 8*i* through a first matching circuit 21*a*. Furthermore, a feed/ ground point 17*b* of flat plate antenna 4 is connected to a terminal 8*l* through a second matching circuit 21*b*.

With such a construction adopted, not only can an effect similar to the third embodiment of the present invention is attained, but a fine adjustment of an antenna characteristic can also be achieved using the first and second matching circuits 21*a* and 21*b*.

(Seventh Embodiment)

Description will be given of the seventh embodiment of a portable telephone according to the present invention with reference to FIG. 7.

Figure 7:
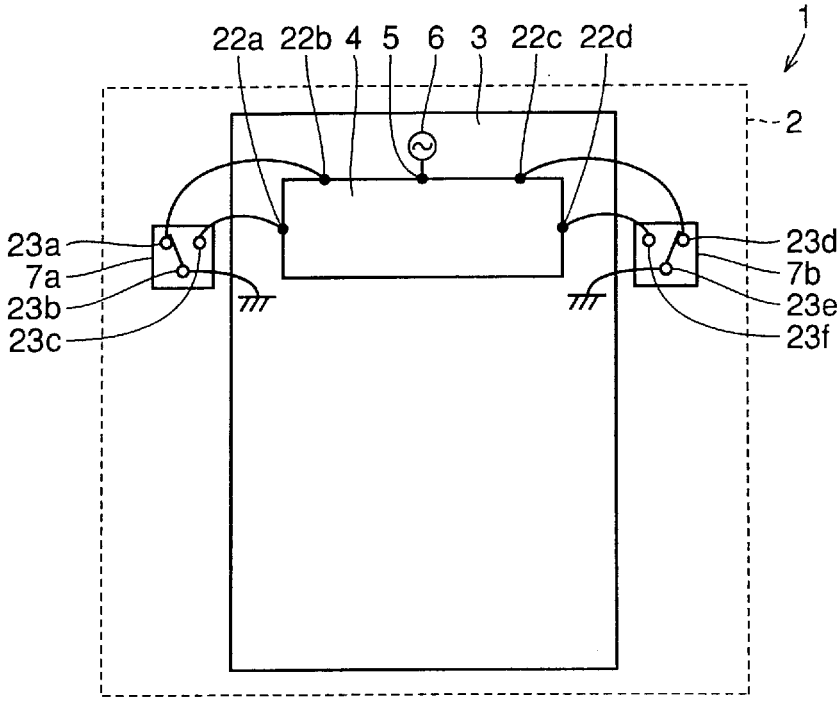
FIG. 7 is a model diagram showing a seventh embodiment of a portable telephone according to the present invention.

Referring to FIG. 7, a portable telephone 1 has a construction fundamentally similar to the portable telephone shown in FIG. 2. However, in portable telephone 1 shown in FIG. 7, change-over ground points 22*a* to 22*t* are provided at two positions in respective both end portions of a flat plate antenna 4. Change-over ground point 22*a* is electrically connected to a terminal 23*c* of a change-over switch 7*a*. Furthermore, change-over ground point 22*b* is electrically connected to a terminal 23*a* of change-over switch 7*a*. A terminal 23*b* grounded to one end portion of a board 3 is disposed on change-over switch 7*a*. Switching between connections of terminal 23*b* with each of terminals 23*a* and 23*c* is enabled in change-over switch 7*a*.

Moreover, change-over ground point 22*c* of flat plate antenna 4 is electrically connected to a terminal 23*d* of a change-over switch 7*b*. Change-over ground point 22*d* is electrically connected to a terminal 23*f* of change-over switch 7*b*. A terminal 23*e* grounded to the other end of board 3 is disposed on change-over switch 7*b*. Switching between connections of terminal 23*e* with each of terminals 23*d* and 23*f* is enabled in change-over switch 7*b*. Moreover, a feed source 6 can feed a current having a first frequency and a current having a second frequency different from the first frequency.

With such a construction adopted, not only can an effect similar to the second embodiment of the present invention, but a position of a ground point of flat plate 4 can be changed by controlling change-over switch 7*a* to select one of change-over ground points 22*a* and 22*b*. As a result, an effective electrical length of flat plate antenna 4 can be changed. Hence, there can be realized portable telephone 1 capable of transmitting/receiving radio waves having respective different frequencies of the first and second frequencies.

(Eighth Embodiment)

Figure 8:
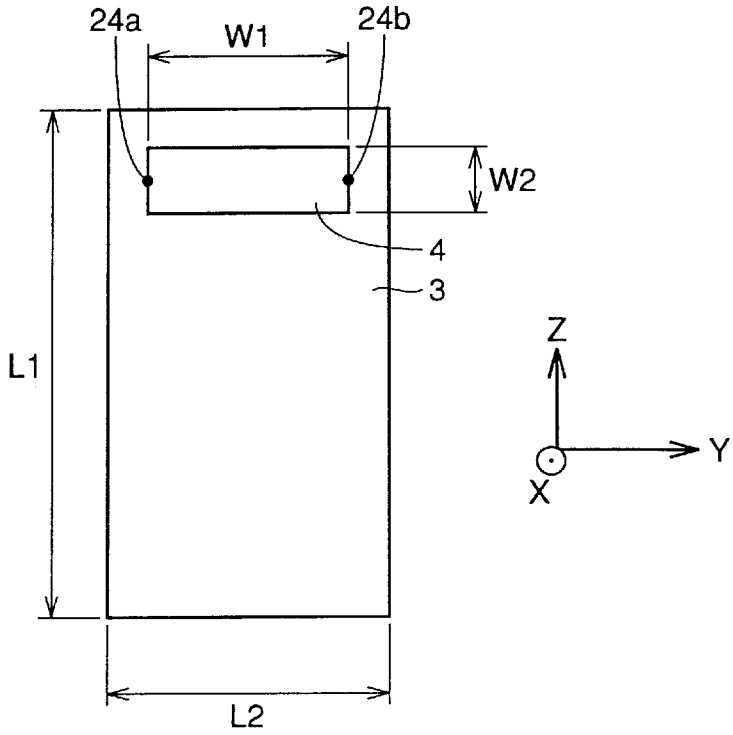
FIG. 8 is a model diagram showing a board and an antenna constituting an antenna device of a portable telephone used in a test.

In order to confirm a characteristic of a portable telephone according to the present invention, the following test was performed. Referring to FIG. 8, a length L1 of a board 3 was 110 mm and a width L2 was 33 mm. A flat plate antenna 4 of a size of 30 mm in width W1 and 5 mm in height W2 was mounted on board 3 with a clearance of 5 mm therebetween. Feed points 24*a* and 24*b* between which switching is possible, and which are connected to feed sources (not shown) were connected to both end portions of flat plate antenna 4. For example, a change-over switch 7 as shown in FIG. 1 can be used as change-over means for feed points 24*a* and 24*b*.

Note that a direction heading for a region in which flat plate antenna 4 is mounted from the bottom portion of board 3 of the figure was used as the +Z direction (a direction heading for above from below of FIG. 8). A direction heading for the left from the right was used as the +Y direction. A direction heading for the front from the back of the sheet of paper of the figure was used as the +X direction.

Figure 9:
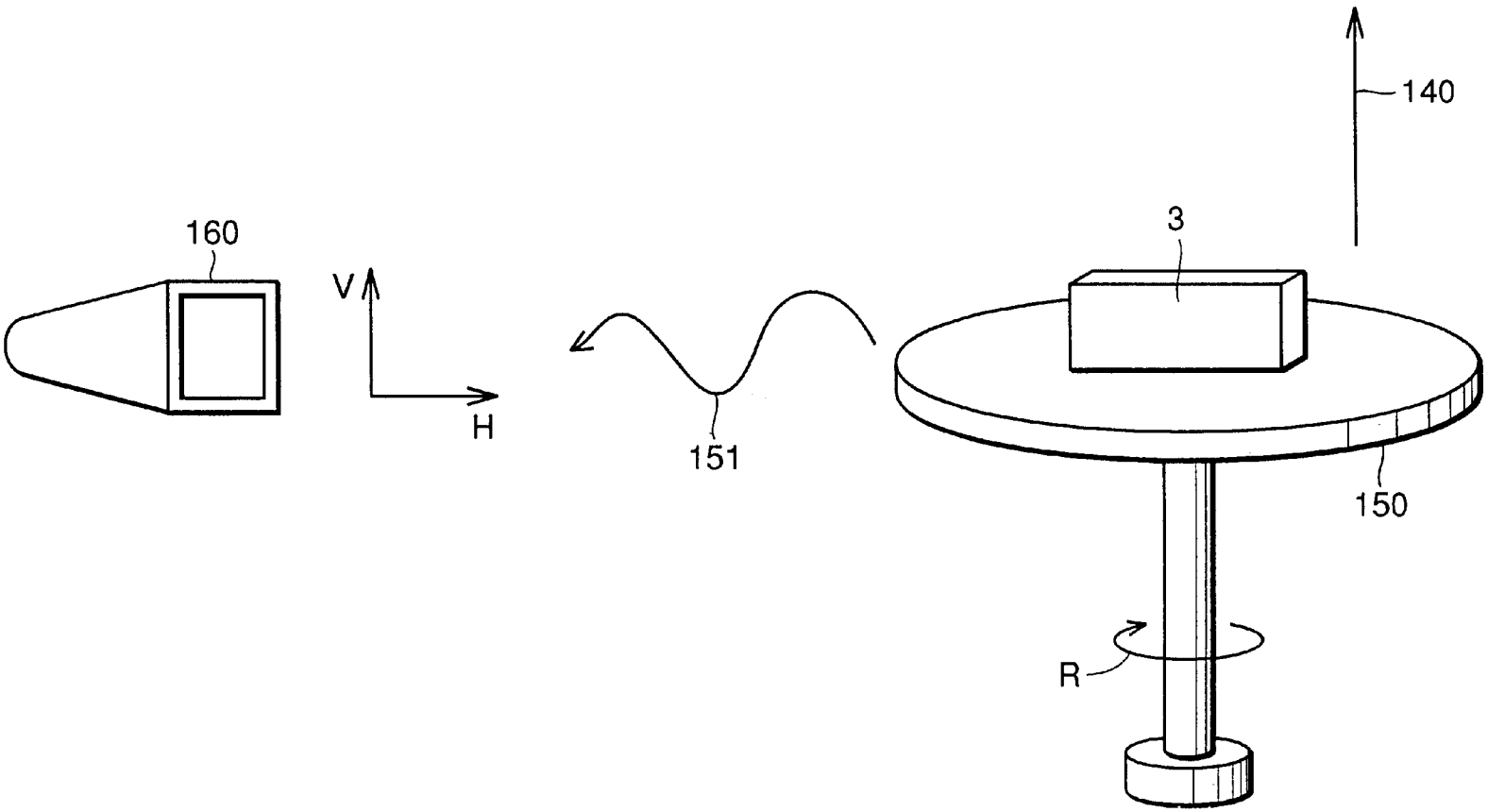
FIG. 9 is an illustration showing a process measuring a radiation pattern in an X-Z plane shown in FIG. 8.

First of all, referring to FIG. 9, an antenna device shown in FIG. 8 was placed on a table 150. At this time, the antenna device was placed such that the +Z direction and the +X direction shown in FIG. 8 were almost perpendicular to a vertical direction shown with an arrow mark 140. Hence, the +Y direction assumes a position almost parallel to a vertical direction. Furthermore, table 150 was rotatable in a direction indicated with an arrow mark R.

In such a state where antenna device is placed on table 150, a radio wave having a frequency of 1.5 GHz is radiated from the antenna device with a prescribed output. Furthermore, at that time, table 150 was rotated in the direction indicated with arrow mark R. With such a construction adopted, a radio wave as shown with an arrow mark 151 was radiated from the antenna device. An electric field strength of the radio wave was measured with a measuring antenna 160. As a result, electric field strengths of a vertically polarized wave in a direction indicated with an arrow mark V, and a horizontally polarized wave in a direction indicated with an arrow H were obtained.

Figure 10:
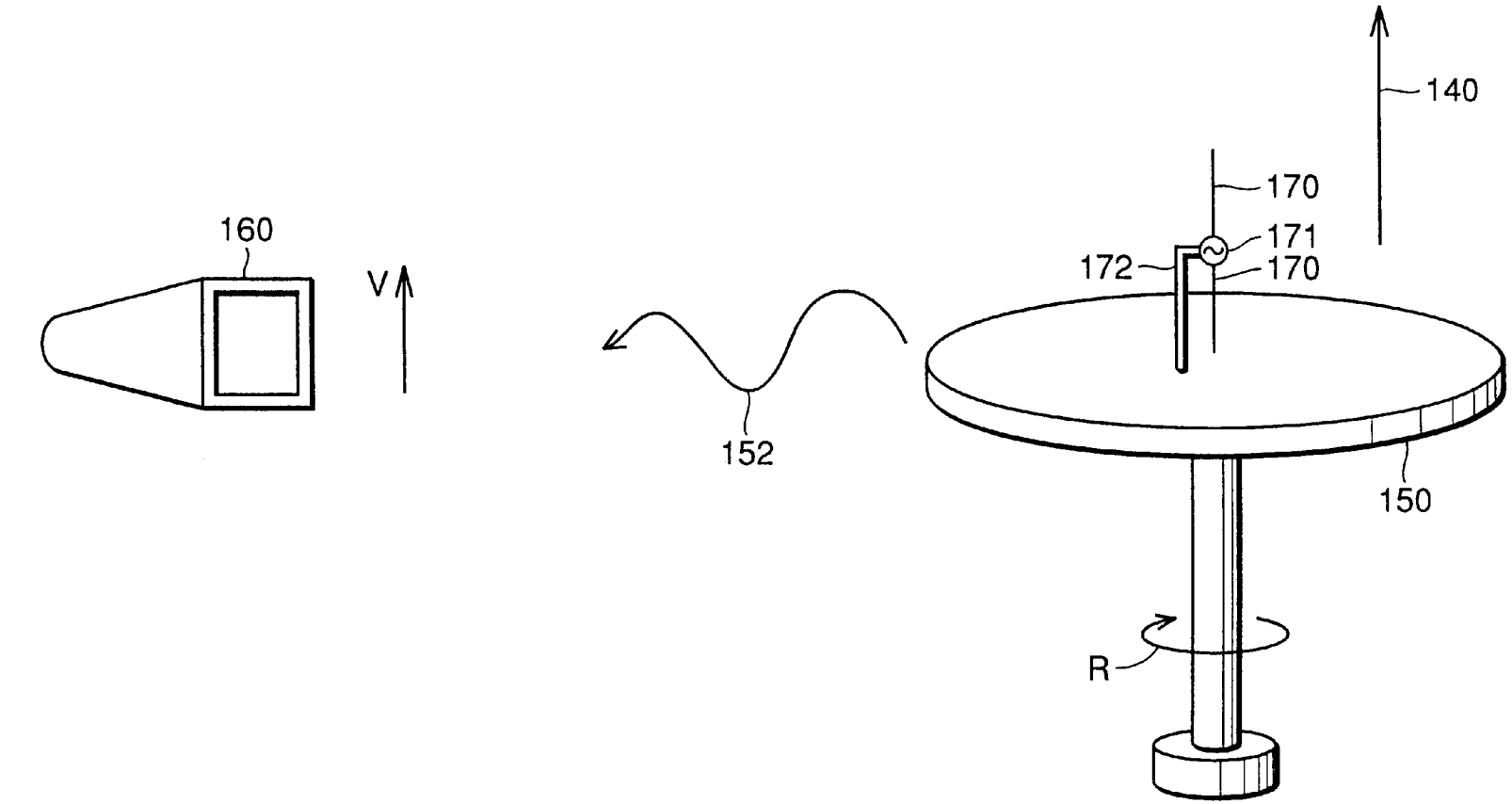
FIG. 10 is an illustration showing a process measuring a radiation pattern in an X-Z plane shown in FIG. 8.

Referring to FIG. 10, a dipole antenna 170 was placed on table 150. In dipole antenna 170, a feed point 171 was provided in the central portion, and feed point 171 was connected to a coaxial cable 172. Coaxial cable 172 was connected to a prescribed wireless receive/transmit section. Dipole antenna 170 was installed so as to extend in a direction almost parallel to a vertical direction indicated with arrow mark 140. By giving an output similar to the output given to an antenna 2 shown in FIG. 7 to dipole antenna 170 while rotating table 150 in the direction indicated by arrow mark R, a radio wave having a frequency of 1.5 GHz was radiated from dipole antenna 170. As a result, a radio wave indicated with an arrow mark 152 was radiated from dipole antenna 170. The radio wave was a vertically polarized wave having a direction indicated with an arrow mark V. An electric field strength of the radio wave was measured with measuring antenna 160.

Figure 11:
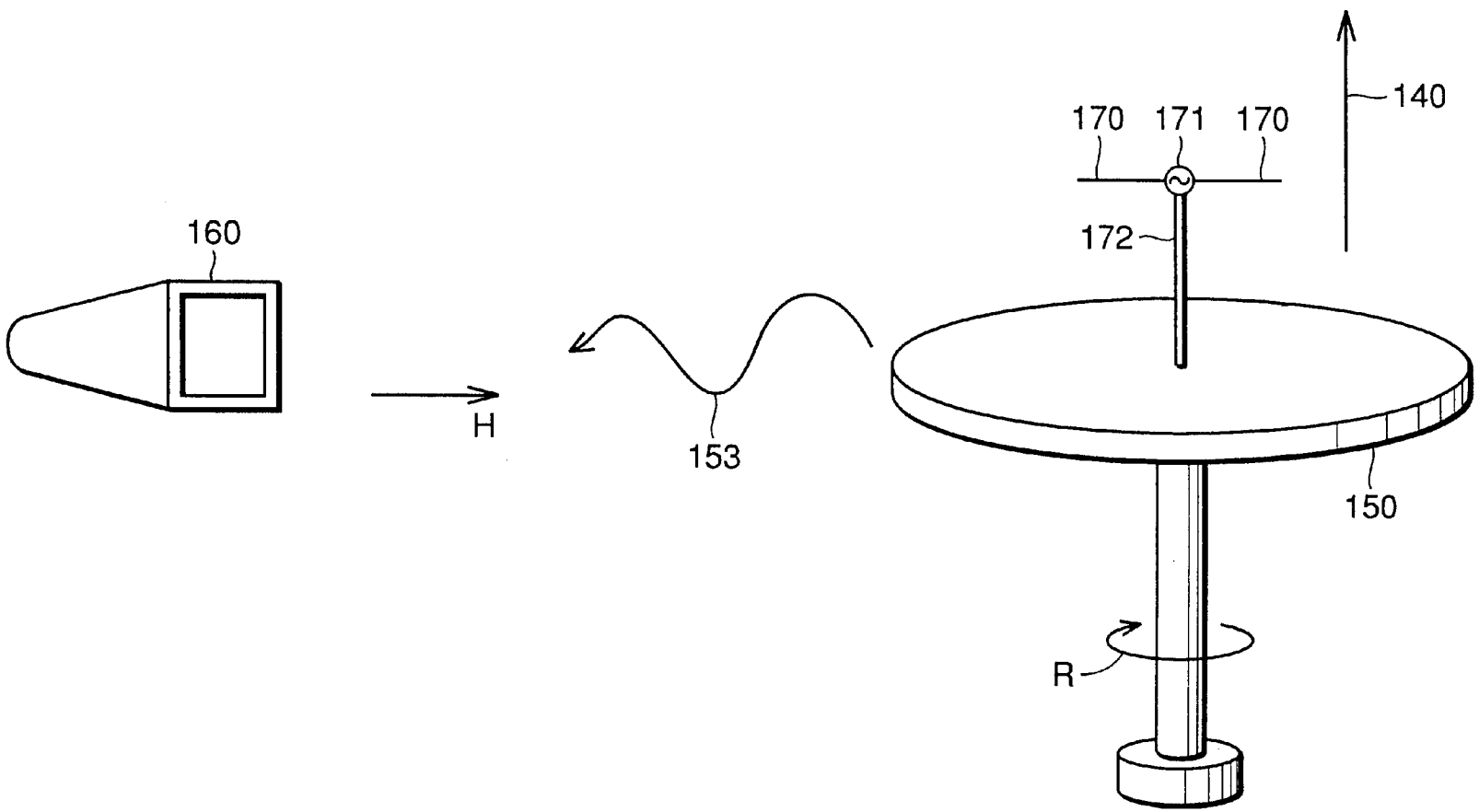
FIG. 11 is an illustration showing a process measuring a radiation pattern in an X-Z plane shown in FIG. 8.

Referring to FIG. 11, dipole antenna 170 was placed on table 150. Dipole antenna 170 was installed so as to extend in a direction almost perpendicular to a vertical direction indicated with arrow 140. Feed point 171 is provided at the center of dipole antenna 170. Feed point 171 was connected to coaxial cable 172. By giving an output similar to the output given to antenna 2 shown in FIG. 7 to dipole antenna 170 while rotating table 150 in the direction indicated with arrow mark R, a radio wave having a frequency of 1.5 GHz and indicated with an arrow 153 was radiated from dipole antenna 170. The radio wave was a horizontally polarized wave having a direction indicated with an arrow mark H. An electric field strength of the radio wave was measured with measuring antenna 160.

A radiation pattern of the antenna device according to the present invention was obtained based on data measured in the processes shown in FIGS. 9 to 11. The results are shown in FIGS. 12 and 13.

Figure 12:
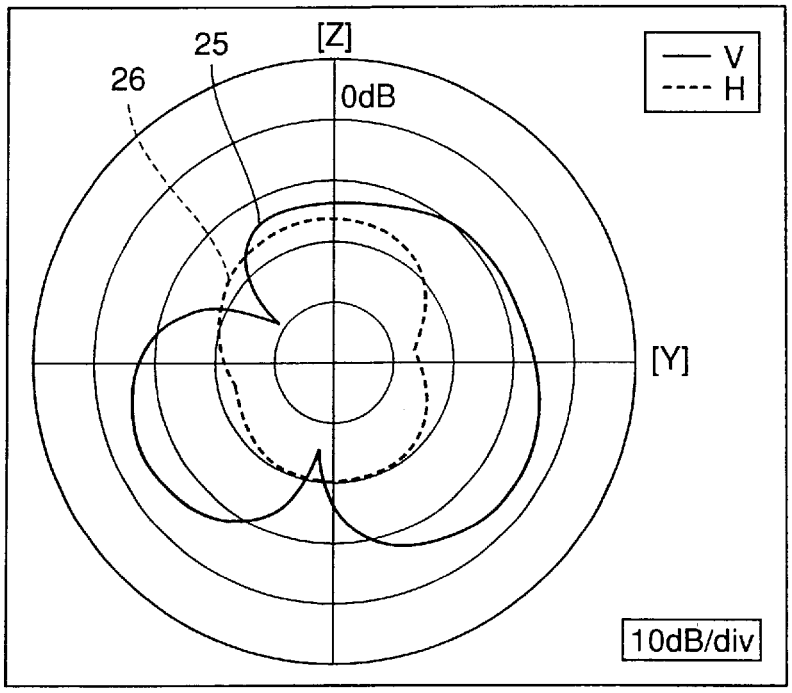
FIG. 12 is a graph showing a radiation pattern when a flat plate antenna 4 is fed from a feed point 24*a* in FIG. 8.
Figure 13:
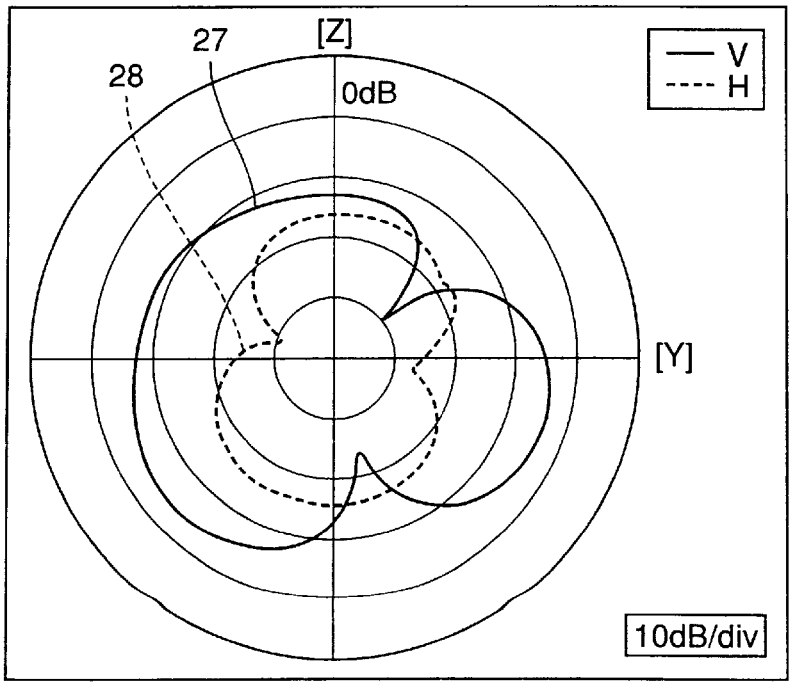
FIG. 13 is a graph showing a radiation pattern when flat plate antenna 4 is fed from a feed point 24*b* in FIG. 8.
Figure 14:
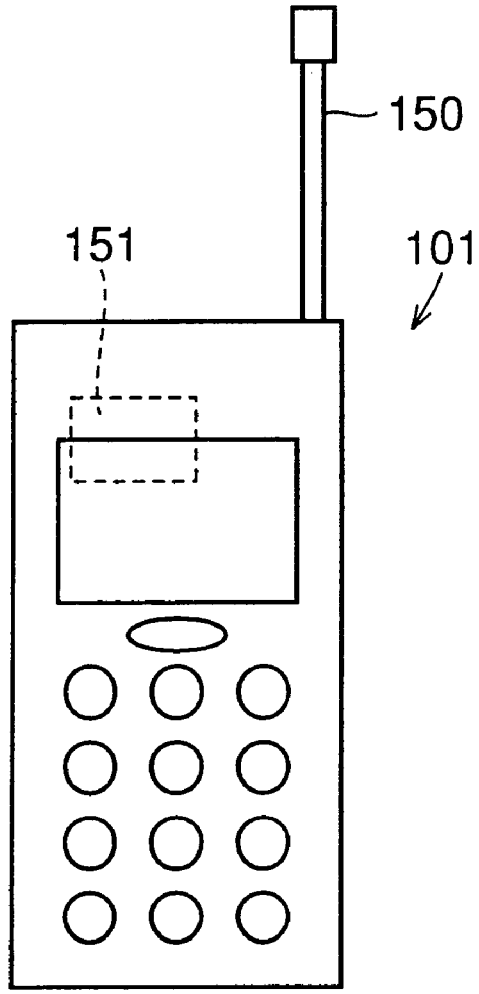
FIG. 14 PRIOR ART
FIG. 14 is a model diagram showing a conventional portable telephone.
Figure 15:
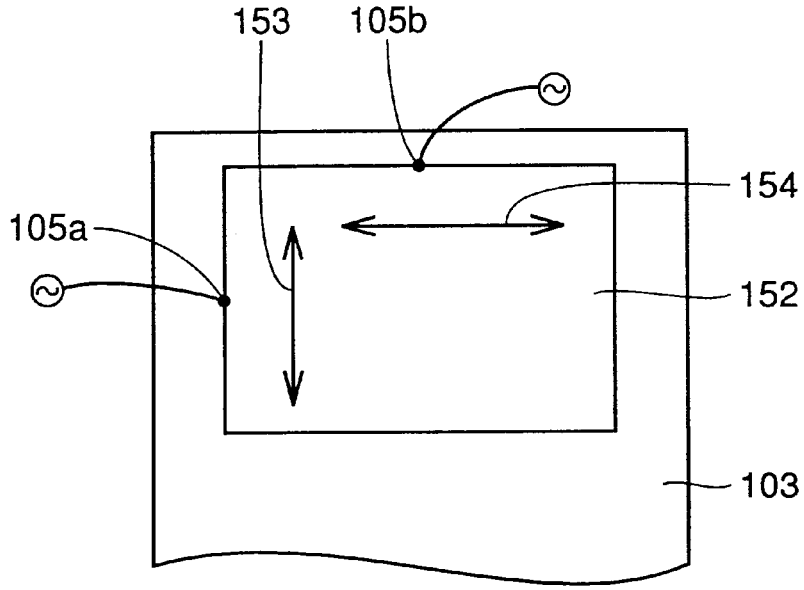
FIG. 15 PRIOR ART
FIG. 15 is a model diagram showing an antenna device adopting a polarization diversity reception scheme.
Figure 16:
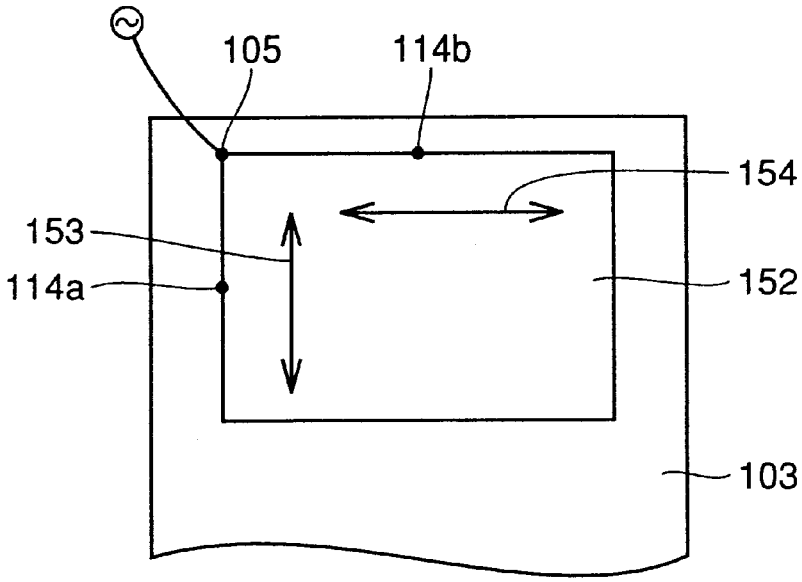
FIG. 16 PRIOR ART
FIG. 16 is a model diagram showing an antenna device adopting a polarization diversity reception scheme.

Referring to FIGS. 12 and 13, solid lines 25 and 27 are a gain of a vertically polarized wave component of a radio wave radiated from the antenna device shown in FIG. 9 to an electric field strength of a vertically polarized wave radiated from dipole antenna 170 in the process shown in FIG. 10. The gain was calculated according to the following formula:

(Gain)=20×$\log_{10}$(an electric field strength of a vertically polarized wave from an antenna device/an electric field strength of a vertically polarized wave from dipole antenna 170)

In addition, dotted lines 26 and 28 are a gain of a horizontally polarized wave component of a radio wave radiated from the antenna device shown in FIG. 9 to an electric field strength of a horizontally polarized wave radiated from dipole antenna 170 in the process shown in FIG. 11. The gain was calculated according to the following formula:

(Gain)=20×$\log_{10}$(an electric field strength of a horizontally polarized wave from an antenna device/an electric field strength of a horizontally polarized wave from dipole antenna 170)

Referring to FIGS. 12 and 13, by switching between feed points 24*a* and 24*b* in the antenna device shown in FIG. 8, it is understood that radiation patterns are inverted from each other laterally. That is, it is understood that by switching between feed points 24*a* and 24*b*, polarization and directivity of an antenna can be changed.

As described above, while description is given of the embodiments of the present invention, features of the embodiments may be combined in a proper way. The embodiments disclosed this time are given by way of illustration but should not be taken by way of limitation in all aspects. The scope of the present invention is not shown by the above embodiments but by the claims and it is intended that the scope of the present invention includes the claims, equivalence of the claims and all modifications or alterations in the claims.

INDUSTRIAL APPLICABILITY

An antenna device and portable equipment according to the present invention can be used in not only a portable telephone, but also in a field of a portable information terminal such as a personal computer having a communication function.

What is claimed is:

1. An antenna device comprising:

a conductive board having one end portion and the other end portion opposite the one end portion;

a flat plate antenna mounted on said board with a dielectric interposing therebetween wherein when feeding a current thereto to excite, a current also flows in said board;

first current direction change means for changing a direction of said current flowing in said board to a first direction when exciting said antenna, and located on said one end portion of said board; and second current direction change means for changing a direction of said current flowing in said board to a second direction different from but intersecting said first direction when exciting said antenna, and located on the other end portion of said board.

2. The antenna device according to claim 1, wherein said antenna is installed so as to extend from a position on said one end portion of said board to a position on the other end portion of said board, said first current direction change means includes:

a first feed means, which is connected to one portion of said antenna located on said one end portion of said board, for exciting said antenna; and a first feed control means for controlling feed of a current to said antenna from said first feed means, and said second current direction change means includes:

a second feed means, which is connected to a second portion of said antenna located on the other end portion of said board, for exciting said antenna; and a second feed control means for controlling feed of a current to said antenna from said second feed means.

3. The antenna device according to claim 1, further comprising:

a feed means for exciting said antenna, wherein said antenna is installed so as to extend from a position on said one end portion of said board to a position on the other end opposite said one end portion of said board, a said first current direction change means includes:

a first ground means for electrically connecting one portion of said antenna located on said one end portion of said board with one end portion of said board; and a first ground control means for controlling connection of said first ground means with said antenna, said second current direction change means includes:

a second ground means for electrically connecting a second portion of said antenna located on the other end portion of said board with the other end portion of said board; and a second ground control means for controlling connection of said second ground means with said antenna.

4. The antenna device according to claim 3, wherein said feed means is connected to the central portion of said antenna;

in said first ground means, said one end portion of said board is connected to said one portion of said antenna at a first ground point of said one portion of said antenna; and in said second ground means, said other end portion of said board is connected to the second portion of said antenna at a second ground point of the second portion of said antenna; and, said first ground point and said second ground point are located at positions in bilateral symmetry with respect to the central portion of said antenna.

5. The antenna device according to claim 1, wherein said antenna is installed so as to extend from a position on said one end portion of said board to a position on the other end portion opposite said one end portion of said board, said first current direction change means includes:

a first ground means for electrically connecting one portion of said antenna located on said one end portion of said board to said one portion of the board;

a first feed means, which is connected to said one portion of said antenna located on said one end portion of said board, for exciting said antenna; and a first feed ground control means for switching between said first ground means and said first feed means, said second current direction change means includes:

a second ground means for electrically connecting a second portion of said antenna located on the other end portion of said board to the other end portion of said board;

a second feed means, which is connected to said second portion of said antenna located on the other end portion of said board, for exciting said antenna; and a second feed ground control means for switching between said second ground means and said second feed means.

6. The antenna device according to claim 1, wherein an electrical length of said antenna is substantially ¼ times a wavelength of a radio wave that can be received by said antenna.

7. The antenna device according to claim 1, wherein said antenna includes:

a first element capable of receiving a radio wave having a first frequency; and a second element capable of receiving a radio wave having a second frequency different from said first frequency.

8. The antenna device according to claim 1, wherein said first current direction change means includes:

a first feed source feeding a current having a first frequency for exciting said antenna;

a second feed source feeding a current having a second frequency different from said first frequency for exciting said antenna;

a first filter transmitting a current having said first frequency; and a second filter transmitting a current having said second frequency, said first feed source is connected to a first common connection point of said antenna through said first filter and said second feed source is connected to said first common connection point of said antenna through said second filter, and wherein said second current direction change means includes:

a third feed source feeding a current having said first frequency for exciting said antenna;

a fourth feed source feeding a current having said second frequency different from said first frequency for exciting said antenna;

a third filter transmitting a current having said first frequency; and a fourth filter transmitting a current having said second frequency, said third feed source is connected to a second common connection point of said antenna through said third filter and said fourth feed source is connected to said second common connection point of said antenna through said fourth filter.

9. The antenna device according to claim 1, wherein said antenna includes a part having a function as a conductive wire for a current fed to said antenna and a function as a matching element.

10. The antenna device according to claim 1, wherein said first current direction change means includes:

a first matching circuit member; and a first feed means electrically connected to said antenna through said first matching circuit member and said second current direction change means includes:

a second matching circuit member; and a second feed means electrically connected to said antenna through said second matching circuit member.

11. A portable equipment comprising an antenna device according to claim 1.

* * * * *